United States Patent [19]

Schlumpf

[11] Patent Number: 4,889,221

[45] Date of Patent: Dec. 26, 1989

[54] VENDING MACHINE FOR NEWSPAPERS OR PERIODICALS

[75] Inventor: Alois Schlumpf, Zumikon, Switzerland

[73] Assignee: Journomat AG., Zurich, Switzerland

[21] Appl. No.: 221,496

[22] Filed: Jul. 19, 1988

[30] Foreign Application Priority Data

Jul. 28, 1987 [GB] United Kingdom ..... 8717882

[51] Int. Cl.[4] ..... G07F 11/14

[52] U.S. Cl. ..... 194/345; 194/350; 221/213; 221/227

[58] Field of Search ..... 221/213, 214, 215, 216, 221/227, 230, 232, 241, 242; 194/345, 350; 232/15, 16

[56] References Cited

U.S. PATENT DOCUMENTS

| | | | |
|---|---|---|---|
| 1,848,628 | 3/1932 | Hebb et al. | 221/213 |
| 3,382,962 | 5/1968 | Nielsen | 194/345 |
| 3,538,724 | 11/1970 | Dauenbaugh | 232/15 X |
| 3,741,464 | 6/1973 | Verbeke | 232/15 |
| 3,926,366 | 12/1975 | Sciortino | 232/15 |
| 4,296,873 | 10/1981 | Schlumpf | 221/213 |
| 4,566,608 | 1/1986 | Draper et al. | 221/232 X |
| 4,730,715 | 3/1988 | Siegenthaler | 232/15 X |

*Primary Examiner*—F. J. Bartuska
*Attorney, Agent, or Firm*—Blum Kaplan

[57] ABSTRACT

The vending machine comprises a housing (17) with a dispensing slot in its front panel (2,3). A table (24) is vertically displaceable and pulled upwards by spring urged chains on either side passing over interconnected sprockets (26). A stack (36) of newspapers (37) is placed on the table (24) and abuts adjacent one of its front corners against a post. An arm (57) containing a pivotable gripper element with gripper needles is pivotable about the vertical axis of the post. The needles are kept retracted until the correct amount has been inserted into a coin slot (7). Then they are released and engage the topmost newspaper (37). When now a handle (12) is operated it pivots the arm (57) about its axis. The newspaper (37) swings about the post until one corner extends through a dispensing slot where it can be pulled out. The machine is particularly constructed to prevent tampering.

15 Claims, 6 Drawing Sheets

62
13
12
X
143
146
151
139
149
148
150
138
2
140
7
147
144
8
10
40
65
64
63
26
22
20
29
23
61
147
24
37
41
6
39
50
42
36
60
38
40
V
V
57
59
49
58
27
56
40
38
VI
VII
VII
51
19
3
50
44
18
21
29
26
22
23
17
16
VI
5

VENDING MACHINE FOR NEWSPAPERS OR PERIODICALS

The present invention relates to a vending machine for newspapers or periodicals.

U.S. Pat. No. 4,296,873 discloses a vending machine for newspapers. The machine comprises a housing with a dispensing slot in its front panel. A table is vertically displaceable in the housing and is pulled upwards by a spring urged chain on either side passing over a sprocket. The two sprockets are interconnected for parallel movement of the table. A stack of newspapers is placed on the table and abuts adjacent one of its rear corners against a post. An arm containing a pivotable gripper element with gripper needles is pivotable about a vertical axis located in the rear part of the housing behind the stack. The gripper element is held in the retracted position of the gripper needles by a releasable catch. When the correct amount of coins has been inserted through coin slots into a coin checking unit the catch is released and the gripper element with the gripper needles drops down for engaging the topmost newspaper of the stack. When now the handle is operated the arm swings about its vertical pivot axis and turns the topmost newspaper about the post so that the corner opposite the post is swung through the dispensing slot where it can be gripped and pulled out.

This known machine works well. However, experience has shown that it is relatively easily tampered with, so that customers could take newspapers without paying. In addition, the drawer containing the accepted coins is not safe against burglary. It also happened that foreign objects like matches or even chewing gum were shoved into the coin slot making the machine inoperable and difficult to repair.

It is an object of the present invention to provide a vending machine of the above type which is safer against tampering.

In accordance with the present invention there is provided an automatic vending machine for newspapers or periodicals which comprises a housing with a dispensing slot in its front panel, a table for supporting a stack of newspapers or periodicals slidably supported for parallel vertical movement and spring urged in the upward direction, a post located at one side above the table against which the stack abuts, an arm pivotable about a vertical pivot axis and containing a pivotable gripper element with gripper needles, a releasable catch for holding the gripper element in the retracted position of the gripper needles, and a handle for pivoting the arm about its axis, the post being located above the front part of the table, the stack abutting with its front part against it, and the vertical pivot axis of the arm being substantially coaxial with the post.

By placing the post above the front part of the stack and arranging the pivot axis of the arm coaxial with the post the stack can be spaced further away from the dispensing slot so that it is less easily accessible through the slot. In addition this makes it possible to place a safeguard in front of the dispensing slot so that the stack is not the accessible from the outside at all.

The invention is described further hereinafter, by way of example only, with reference to the accompanying drawings, in which.

Figure 1:
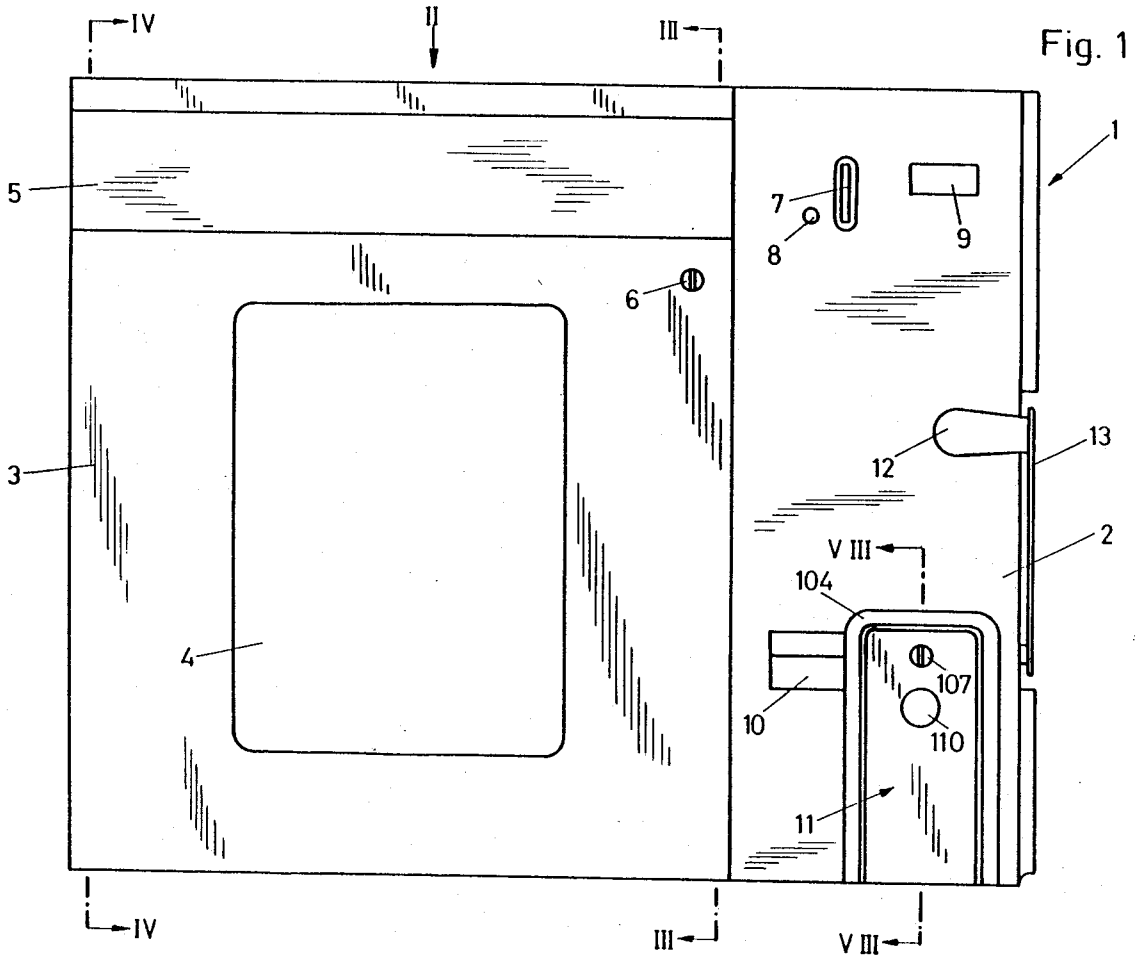
FIG. 1 is a front view of one embodiment of a newspaper vending machine in accordance with the present invention.

FIG. 1 shows a front panel 1 of a vending machine, consisting of a fixed front plate 2 and a door 3 hinged at its lower edge. The door 3 contains a window 4 for showing the newspaper on sale, a cover plate 5 slanting down and outwards and covering a dispensing slot, and a key operated lock 6. The fixed plate 2 has a coin slot 7, a return button 8, a window 9 with a display of the amount to be paid, a return tray 10 for non-accepted coins and a key locked door 11 for access to a drawer containing the cashed coins. A handle 12 operating a lever 13 extends out in front of the plate 2 and is used for extracting a newspaper.

Figure 2:
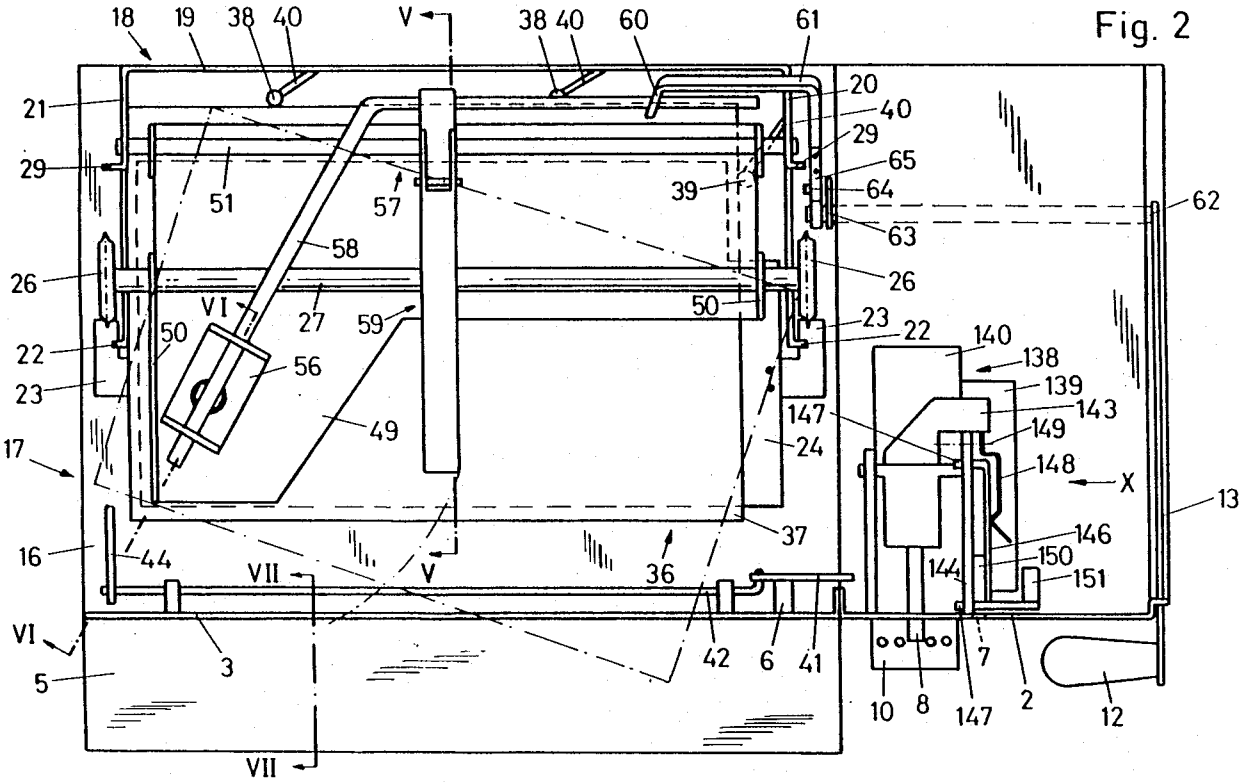
FIG. 2 is a top view in the direction II in FIG. 1.
Figure 3:
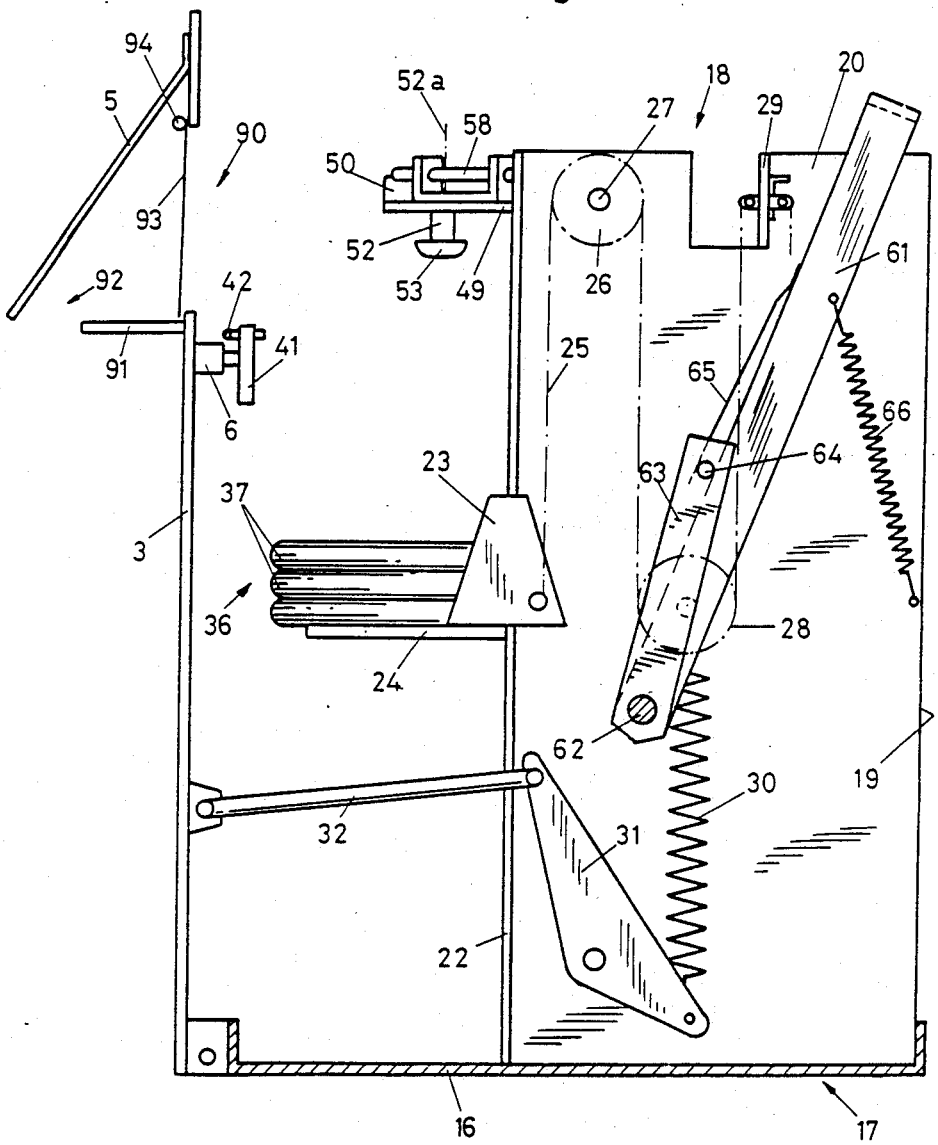
FIG. 3 is a cross-section along the line III—III in FIG. 1.
Figure 4:
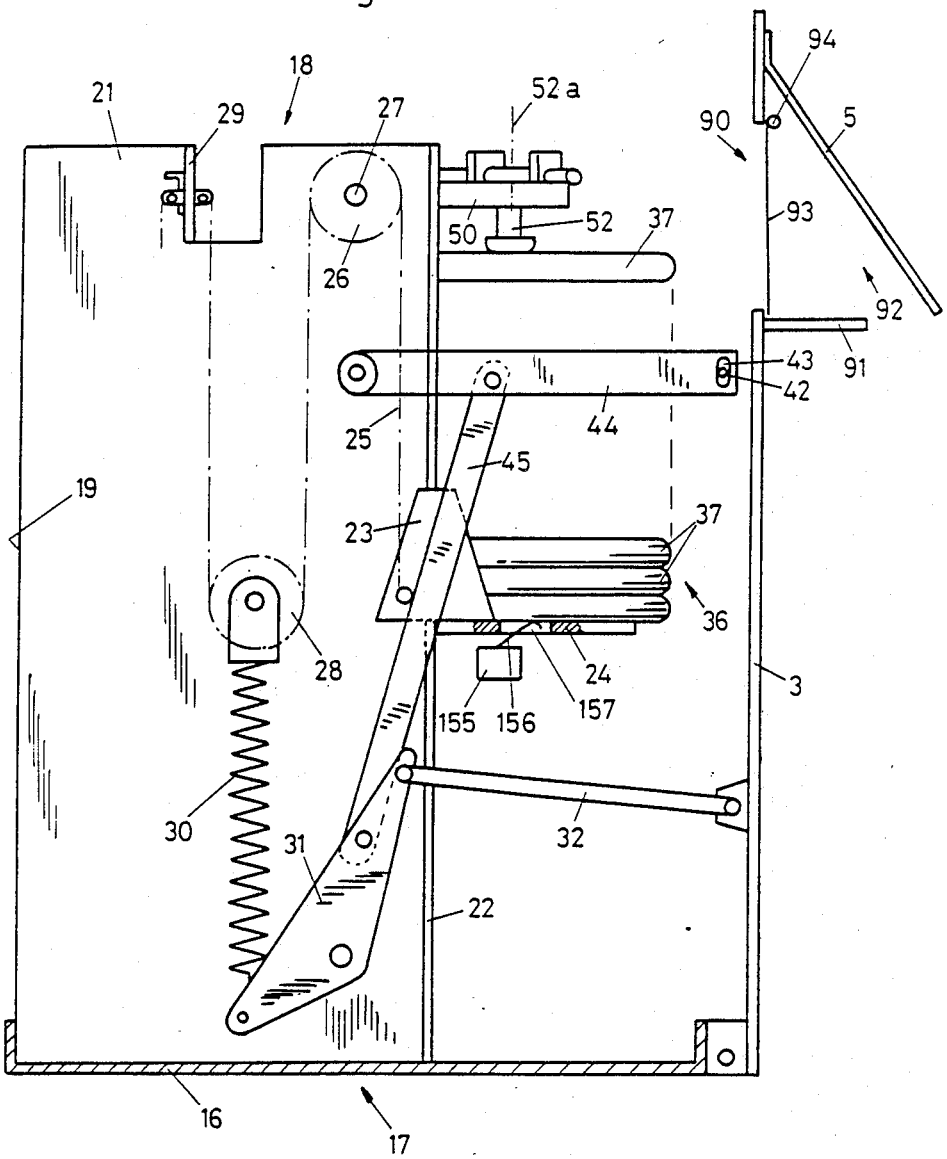
FIG. 4 is a cross-section along the line IV—IV in FIG. 1.

Referring now to FIGS. 2, 3 and 4 the door 3 is hinged to a bottom plate 16 of a housing 17. The housing 17 comprises a generally U-shaped vertical support 18 with a rear wall 19 and two side plates 20, 21. The free ends of the side plates 20, 21 are bent outwards forming vertical guide rails 22 on which sleds 23 are guided. The two sleds 23 are attached to a horizontal table 24 guiding it with respect to a tilting axis parallel to the front panel 1. Each sled is carried by a chain 25 led over a sprocket 26 fastened to a shaft 27 extending transversely between and being rotatably supported by the sideplates 20, 21 at their upper ends. The chains 25 pass a roller 28 and are fixed at their outer end to flaps 29 extending from the sideplates 20, 21 at their upper end. The rollers 28 are urged downwardly by springs 30 attached to levers 31 pivotably supported at the lower end of the sideplates 20, 21. The levers 31 are connected to the door 3 by bars 32 pivotable at either end. When the door 3 is opened the bars 32 pull the levers 31 down releasing tension on the springs 30 so that the table 24 is lowered. This facilitates loading of the table 24 by a stack 36 of newspapers 37. By the interconnected sprockets 26 the table 24 is secured against tilting about an axis perpendicular to the front panel 1. The stack 36 abuts against the sideplate 21 on one side, against two vertical guide bars 38 with circular cross section with its rear side and against a further vertical bar 39 with its other side. Bar 39 is located adjacent the rear corner of the stack 36. The bars 38, 39 are welded to flaps 40 formed by U-shaped cutouts from the rear wall 19 and the sideplate 20. By bending the flaps 40 the bars 38, 39 can be adjusted to the size of newspapers to be sold. The bar 39 is particularly useful in helping to separate the topmost newspaper from the rest of the stack when vending a certain type of periodicals. For periodicals it is not usually required and can then be left spaced away from the stack.

The door lock 6 rotates a double-armed lever 41 which catches with its one arm behind the fixed plate 2 in the locked position and pushes with its other arm a rod 42 into a vertical slot 43 of a lever 44 pivoted at its rear end to the sideplate 21. When the door 3 is opened the lever 44 is swung down by a bar 45 connecting levers 31, 44. This facilitates loading of the table 24.

Figure 6:
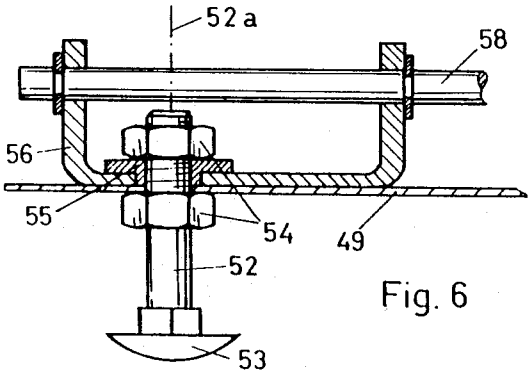
FIG. 6 is a cross-section along the line VI—VI in FIG. 2.

A horizontal mounting plate 49 passes underneath the shaft 27 and surrounds it by slots in reinforcing side flanges 50 of the plate 49. The rear end of the flanges 50 is pivotably supported on the side plates 20, 21 by a rod 51. The mounting plate 49 carries a vertical post 52 with a spherical bottom surface 53 on the side adjacent plate 21 and above the front part of the table 24. The post 52 is formed by a screw and fastened to the mounting plate 49 by two nuts 54 via a flanged bushing 55 (FIG. 6). A U-shaped carrier 56 is pivotably supported by the bushing 55 for pivoting about the axis 52*a* of the post. The carrier 26 carries an arm 57 consisting of an angled bar 58 and a pushing lever 59 pivotable at its rear end on the rear section of the bar 58. The front end of the bar 58 is rotatably supported in the two legs of the U-shaped carrier 56 and secured against axial movement. The free end of the bar 58 is passed with considerable clearance through a hole in the bent end 60 of an L-shaped actuating lever 61. The lever 61 is pivotably supported by a horizontal shaft 62 fixed to the lever 13. A lever 63 carrying a horizontal pin 64 at its free end is fixed to the shaft 62. A leaf spring 65 fixed to the front side of lever 61 urges the pin 64 against the lever 61 for conjoint movement of levers 61, 63. Lever 61 is urged rearwardly by a further spring 66 which is considerably weaker than leaf spring 65. Leaf spring 65 and pin 64 form an overload protection in case the pushing lever 59 gets jammed.

Figure 5:
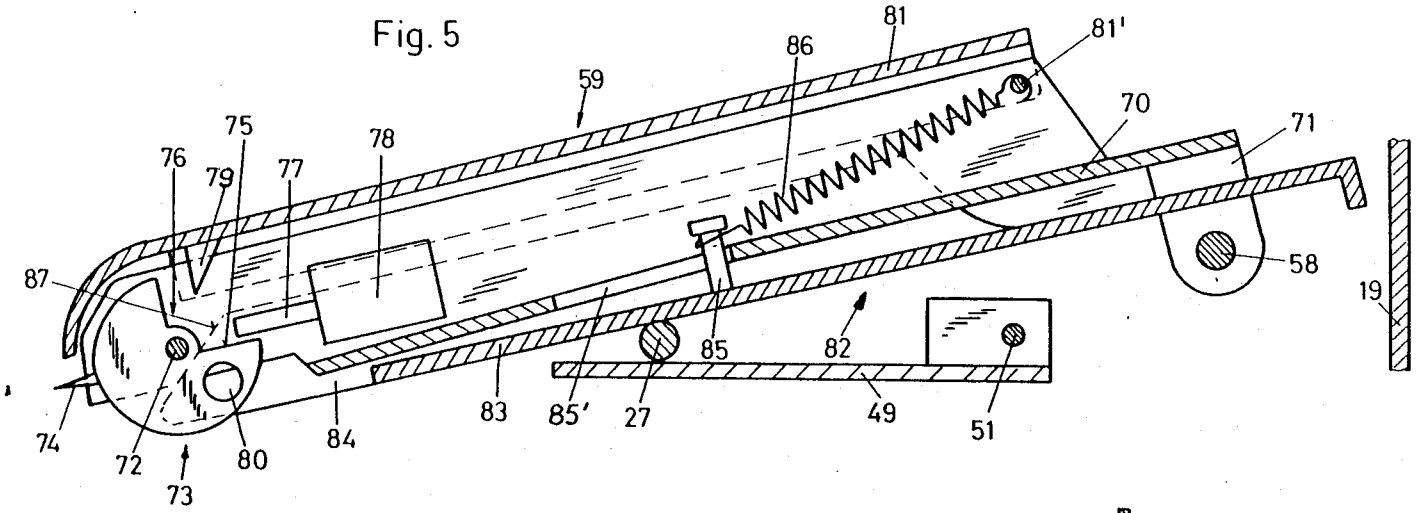
FIG. 5 is a cross-section along the line V—V in FIG. 2.

Referring now particularly to FIG. 5 the pushing lever 59 comprises an elongate carrier 70 with a U-shaped upwardly directed cross section over most of its length. At the rear end two flanges 71 are bent downwards and are rotatably supported on the rear section of bar 58. The front ends of the side legs of the carrier 70 support a horizontal pin 72 extending over the side legs on both sides. A gripper element 73 with two gripper needles 74 is pivotable about the pin 72. The gripper element 73 is a segment of 270° of a circular cylinder. One of the surfaces 75 of the cutout 76 in the segment cooperates with a catch formed by a longitudinally displaceable rod 77 of a solenoid 78. The rod 77 is spring urged to the extended position shown in FIG. 5 and retracted by an electrical signal to the solenoid 78. When the solenoid 78 is actuated the gripper element 73 pivots about pin 72 by gravity until the surface 75 abuts a stop 79 so that the needles 74 point down forwardly against the stack 36. To increase the eccentricity of the center of gravity the gripper element 73 has a trough bore 80. The inside of the carrier 70 is protected by an elongate U-shaped cover 81 pivotably attached by a pin 81' for maintenance and repair purposes. The lower side of the carrier 70 is embraced by a U-shaped lift element 82 with a bottom plate 83 and two side plates 84. A bolt 85 penetrating a slot 85' in the carrier 70 is fixed to the plate 83. A spring 86 connects the bolt 85 to the pin 81' and urges the lift element 82 rearwardly and upwardly with respect to the pushing lever 59 against a stop formed by the rear end of slot 85'. In the rearmost position of the arm 57 the rear end of the lifting element 82 abuts against the rear wall 19. Thereby the lift element 82 is pushed forward with respect to the pushing lever 59 and is pushed with the inclined front surfaces 86 of the side plates 84 underneath the pin 72 lifting the gripper element 73 off the stack 36, if the stack is high and uneven. Normally, however, in the rear position of the arm 57 the lift element 82 rests on the shaft 27 so that the gripper element 73 is above the horizontal plane of the post 52.

Figure 7:
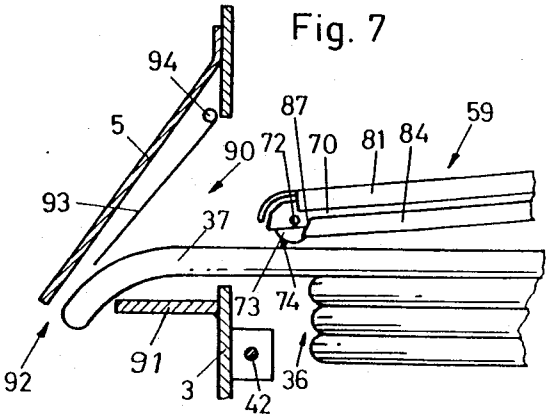
FIG. 7 is a cross-section along the line VII—VII in FIG. 2.

Referring now to FIG. 7, when the correct amount of coins has been inserted into the coin slot 7 a pulse is applied to solenoid 78 so that the needles 74 drop down towards the topmost newspaper 37 of the stack 36. When now the handle 12 is pushed down the arm 57 is pivoted about the axis 52*a* of the post 52. The needles 74 grip the topmost newspaper 37 and pivot it about the post 52. The pressure of the post against the stack is regulated to some extent by the frictional engagement of the mounting plate 49 with the shaft 27. When the pressure is too high the shaft 27 is braked reducing the lifting force of the chains 25 on the sleds 23. The front right corner of the newspaper 37 first reaches a first dispensing slot 90 in the door 3 which is covered by the cover plate 5. Immediately adjacent the lower edge of the slot 90 a horizontal bottom plate 91 extends from the door 3 outwardly. A second dispensing slot 92 is formed between the free edges of the cover plate 5 and the bottom plate 91. When entering the slot 90 the newspaper 37 pushes open a flap 93 covering the slot 90 and pivotably attached to the outside of the door 3 for pivoting about an axis 94 above the dispensing slot 90. The corner of the newspaper then emerges from the second dispensing slot 92. When the handle 12 is released the arm 57 swings back and the gripper element 73 rolls back on its cylindrical surface until the rod 77 catches behind the surface 75. The dispensed newspaper 37 can now be pulled out.

Figure 8:
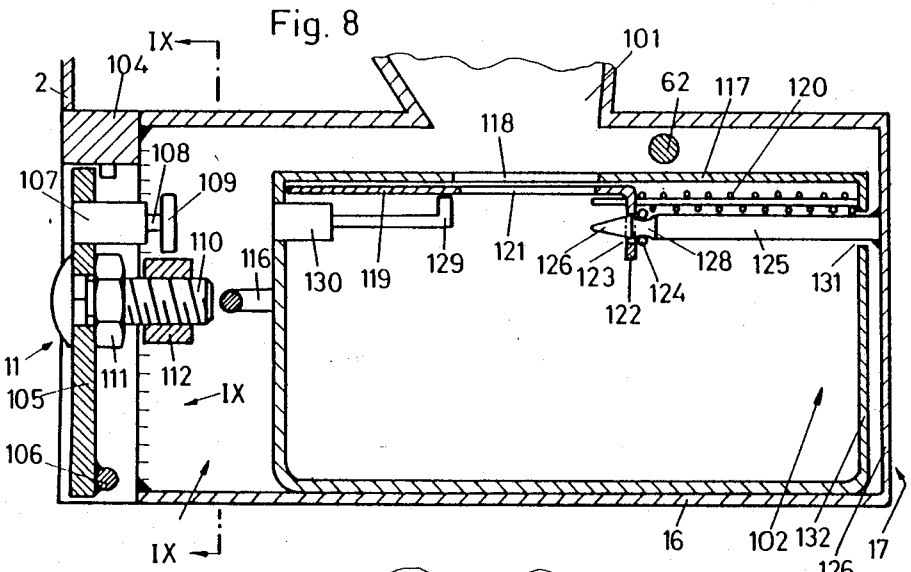
FIG. 8 is a cross-section along the line VIII—VIII in FIG. 1.
Figure 9:
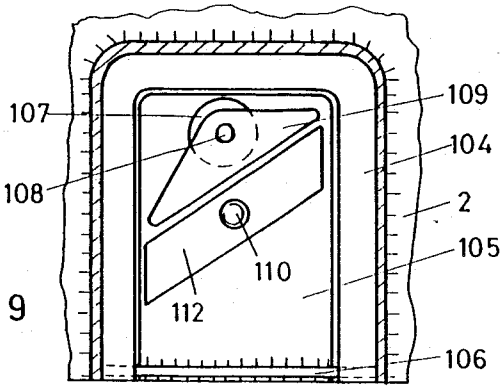
FIG. 9 is a cross-section along the line IX—IX in FIG. 8.

Referring now particularly to FIGS. 8 and 9 the accepted coins fall through a funnel 101 into a drawer 102 located in a partition 103 of the housing 17. The front end of the partition 103 is surrounded by a massive U-shaped armature 104 welded to the fixed plate 2. The door 11 consisting of a thick steel plate 105 is hinged to the lower end of the two legs of the armature 104 by a steel bar 106 welded to the plate 105. In the center line of the plate 105 adjacent its upper end a key operated lock 107 is mounted. The lock cylinder carries a coaxial bar 108 to which a triangular lever 109 is fixed. Below the lock 107 a massive lock-screw 110 is mounted in a square opening of plate 105 by a nut 111. A parallelogram shaped massive steel bar 112 is threaded onto the screw 110. One long side of the bar 112 is adjacent the long side of the lever 109. When the lock 107 is turned clockwise from the open position represented in FIG. 9 the lever 109 pushes the bar 112 into the locked position where its ends catch behind the armature 104 and lock the door 11 in its closed position. The threaded engagement of the bar 112 on the screw 110 serves three purposes, namely to allow pivoting motion, to fix it axially and to provide a wedging motion.

Figure 10:
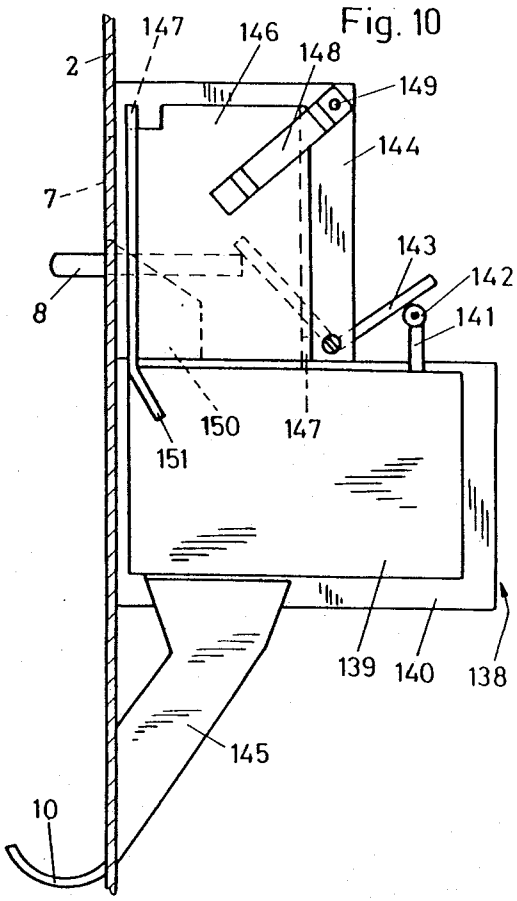
FIG. 10 is a view in the direction X in FIG. 2.

The drawer 102 has a handle 116 which is proximate a part of the door 11 when the door is closed to make sure that the drawer is inserted all the way. A top cover 117 contains an opening 118 which is flush with the funnel 101 when the drawer 102 is inserted. A slide plate 119 is slidably guided in lateral grooves adjacent to the top cover 117. The slide plate 119 is urged forwards by a spring 120 into the open position where an opening 121 is flush with the opening 118. The rear end of the slide plate 119 is bent down forming an extension 122 with a central bore 123. Two spaced spring steel wires 124 are fixed to extension 122 covering partly the bore 123. A round bar 125 is welded to the rear wall 126 of the partition 103, extending forwardly through a hole 131 in the rear wall 132 of the drawer 102. The tip 126 of the bar 125 is conical. Behind the tip 126 the bar 125 has an annular groove 128. When inserting the drawer the tip 126 spreads the wires 124 apart. In the fully inserted position the wires 124 snap into the groove 128 with a releasing force that is greater than the force of spring 117. Therefore, when the drawer 102 is pulled forward the slide plate 119 is held back until it hits a stop (not shown) and the opening 118 is completely closed. In that position a key operated spring urged latch 129 catches behind the front edge of the slide plate 119, and the slide plate 119 remains locked in the closed position until the latch 129 is operated by an appropriate key inserted into a key lock 130. When the drawer 102 is pulled further forward the bar 125 snaps off the wires 124. That way the person collecting the drawers 102 of several vending machines is protected against suspicion when the amount contained in the drawers does not match the number of newspapers sold. Referring now particularly to FIGS. 2 and 10 the vending machine contains an electro-mechanical coin checking unit 138 for checking coins of different value entered through a single coin slot 7. Such units are commercially available and comprise a hinged cover 139 on one side which can be moved away from the fixed part 140 of the unit 138 by pressing on a lever 141 with a roller 142 on its free end. The lever 141 is spring urged upwardly and the roller 142 abuts against one leg of an L-shaped actuating lever 143. The lever 143 is hinged at its bend to a fixed plate 144. Its other end abuts against the rear end of the return button 8. Therefore, by pushing the bottom 8 the lever 141 is pushed down separating the cover 139 slightly from part 140 so that unaccepted or overpaid coins drop into a return channel 145 and out into the return tray 10. The right side of the fixed plate 144 as shown in FIG. 2 is flush with the left edge of the coin slot 7. Spaced away from the fixed plate 144 by a distance slightly bigger than the width of the coin slot 7 is a movable plate 146. The plate 146 is positioned relative to the fixed plate by legs 147 projecting from plate 146 and extending through corresponding openings in the fixed plate 144. The plate 146 is urged by a leaf spring 148 against the plate 144. The spring 148 is fastened to the fixed plate 144 by a rivet 149 and is pivotable about that rivet. On the lower front side the plate 146 abuts against a spacer 150 with a slanted upper edge that leads the inserted coins to the unit 138. A leg 151 projects from the lower forward corner of the movable plate 146 and overlaps the cover 139. Therefore, when the cover 139 is moved away from the part 140 by pushing the return bottom 8 the movable plate 146 is taken along so that the gap between plates 144, 146 widens and foreign objects that might be jammed between the plates 144, 146 are released and dropped into the return tray. In case sticky objects like chewing gum had been shoved through the coin slot 7 the leaf spring 148 is swung away and the movable plate 46 lifted off the plate 144. The two surfaces of those plates facing each other can then easily be cleaned.

The coin checking unit 138 together with the plates 144, 146 can be hinged at its front left edge (as viewed in FIG. 2) to the fixed plate 2 for pivoting about a vertical axis adjacent the left edge of plate 2. When the door 3 is open the coin checking unit 138 can be swung out by 180° for easier maintenance.

When the last newspaper 37 of the stack 36 has been sold the gripper element 73 should be prevented from being released by the rod 77 in order to protect the needles 74. To that end a switch 155 is mounted to the lower side of the table 24 (FIG. 4). A switch lever 156 protrudes through an opening 157 in the table adjacent the vertical projection of the post 52. The lever 156 is pushed down by the stack 36 and is released when the table 24 is empty interrupting the signal to the solenoid 78.

If the vending machine is intended for selling different size periodicals e.g. on different days of the week then the bars 38, 39 can be made adjustable e.g. by substituting leaf springs biased against eccentrics for the flaps 40. By turning the eccentrics the position of the bars 38 can be adjusted. In that case it is also advantageous to have the axis **52*a* adjustable. To that end the post 52 (FIG. 6) may be mounted in an elongated slot in plate 49**.

I claim:

1. An automatic vending machine for newspaper or periodicals which comprises a housing having a front panel formed with a dispensing slot in the front panel, a table for supporting a stack of newspapers or periodicals slidably supported for parallel vertical movement within the housing, a spring for biasing the table in the upward direction, a post disposed adjacent one edge of table above the front of the table, the stack abutting against the post, an arm pivotable about a vertical pivot axis substantially coaxial with the post and containing a pivotable gripper element with gripper needles, a releasable catch for holding the gripper element in the retracted position of the gripper needles, and a handle for pivoting the arm about its axis, said arm including a bar which is pivotable about said vertical pivot axis and a pushing lever pivotably supported at its rear end by said bar, and wherein said gripper element is a segment of about 270° with a cylindrical rolling surface rotatably supported at the front end of said pushing lever, said catch cooperating with one of the surfaces of the cutout in said segment and said needles extending from the cylinder in approximately the opposite direction to said one of the surfaces.

2. A vending machine as claimed in claim 1, wherein a cover plate slanting down and outwards is fixed to said front panel above said dispensing slot, a bottom plate is fixed underneath said cover plate below said dispensing slot forming a further slot between the free edges of said cover plate and said bottom plate, and wherein a flap covering said first dispensing slot is pivotably attached to the outside of said front panel for pivoting above an axis above said first dispensing slot.

3. A vending machine as claimed in claim 1, wherein a lift element extending with its one end to the lower side of said gripper element is attached to said pushing lever, being slidable longitudinally, pivotable vertically and moveable rearwardly with respect to said pushing lelver, a second spring, the second spring biasing said lift element rearwardly and wherein said lift element in the rearmost position of said arm abuts against a stop fixed to said housing whereby said lift element is moved forwardly with respect to said pushing lever and said pushing lever is lifted with respect to said lift element to lift said gripper element off said stack.

4. A vending machine as claimed in claim 1, wherein said table is guided on at least one side with respect to a tilting axis parallel to said front panel and is supported on both sides by a spring loaded chain passing over a sprocket, said sprockets being interconnected by a transversal shaft supported in said housing, and wherein said post and said arm are attached to a mounting element abutting said shaft and being pivotable about an axis parallel to said shaft, and wherein said pushing lever in the rearmost position of said arm passes closely above said shaft.

5. A vending machine as claimed in claim 1, containing a spring urged overload protection between said handle and said arm.

6. A vending machine as claimed in claim 1, wherein the side of said stack adjacent to said post and the rear side of said stack abut against vertical guide elements respectively, and wherein a further vertical guide element is located on the side of said stack opposite said post proximate the rear corner.

7. A vending machine as claimed in claim 1, wherein said front panel contains a coin slot for inserting coins and a coin checking unit located below said coin slot on the rear side of said front panel and with a return button operating on said unit for returning the inserted coins, wherein a fixed vertical plate is fastened immediately adjacent one side edge of said coin slot, a second spring, a movable plate is releasably secured to and biased by the second spring against said fixed plate and held by spacers a distance slightly longer than the width of said coin slot apart from said fixed plate, and wherein said movable plate is connected to said return button for displacement away from said fixed plate upon pressing of said return button.

8. A vending machine as claimed in claim 4, wherein a lift element extending with its one end to the lower side of said gripper element is attached to said pushing lever, being slidable longitudinally, pivotable vertically and moveable rearwardly with respect to said pushing lever, a second spring, the second spring biasing said lift element rearwardly and wherein said lift element in the rearmost position of said arm abuts against a stop fixed to said housing whereby said lift element is moved forwardly with respect to said pushing lever and said pushing lever is lifted with respect to said lift element to lift said gripper element off said stack.

9. An automatic vending machine for newspaper or periodicals which comprises a housing having a front panel formed with a dispensing slot in the front panel, a table for supporting a stack of newspapers or periodicals slidably supported for parallel vertical movement within the housing, a spring for biasing the table in the upward direction, a post disposed adjacent one edge of the table above the front of the table, the stack abutting against the post, an arm pivotable about a vertical pivot axis substantially coaxial with the post and containing a pivotable gripper element with gripper needles, a releasable catch for holding the gripper element in the retracted position of the gripper needles, and a handle for pivoting the arm about its axis, a coin checking unit for accepting or rejecting coins, a drawer coupled to the coin checking unit for receiving the accepted coins, the drawer having a top cover having an opening for receiving accepted coins, the drawer being accessible via a key locked hinged door in said front panel, said opening extending over less than half of the length of said top cover, a slide plate being located below said top cover for closing said opening, a spring for biasing said slideplate forwards into the open position and a catch for holding the slideplate in the closed position, the catch being releasable by a key, and wherein a rear wall of said drawer contains a hole through which in the inserted position of said drawer a bar fixed to said housing of the vending machine extends and which is releasably snapped to said slide plate with a force exceeding the spring urging force of said slide plate.

10. A vending machine as claimed in claim 9, wherein the key operates a rod pivotable about an axis perpendicular to said door, a lever being fixed to said rod, wherein said door consists of a massive steel plate closing into a massive U-shaped armature, a said lever cooperates with a massive bar pivotable on a stud parallel to said rod, said bar in the locked position catching behind said armature.

11. A vending machine as claimed in claim 9, wherein a cover plate slanting down and outward is fixed to said front panel above said dispensing slot, a bottom plate is fixed underneath said cover late below said dispensing slot forming a further slot between the free edges of said cover plate and said bottom plate, and wherein a flap covering said first dispensing slot is pivotably attached to the outside of said front panel for pivoting about an axis above said first dispensing slot.

12. A vending machine as claimed in claim 9, wherein said arm comprises a bar which is pivotable about said vertical pivot axis and a pushing lever pivotably supported at its rear end by said bar, and wherein said gripper element is a segment of about 270° with a cylindrical rolling surface rotatably supported at the front end of said pushing lever, said catch cooperating with one of the surfaces of the cutout in said segment and said needles extending from the cylinder in approximately the opposite direction to said one of the surfaces.

13. A vending machine as claimed in claim 12, wherein said table is guided on at least one side with respect to a tilting axis parallel to said front panel and is supported on both sides by a spring loaded chain passing over a sprocket, said sprockets being interconnected by a tranversal shaft supported in said housing, and wherein said post and said arm are attached to a mounting element abutting said shaft and being pivotable about an axis parallel to said shaft, and wherein said pushing lever in the rearmost position of said arm passes closely above said shaft.

14. A vending machine as claimed in claim 9, containing a spring urged overload protection between said handle and said arm.

15. A vending machine as claimed in claim 9, wherein the side of said stack adjacent to said post and the rear side of said stack abut against vertical guide elements respectively, and wherein a further vertical guide element is located on the side of said stack opposite said post proximate the rear corner.

* * * * *